US008814001B2

(12) United States Patent
Birkler et al.

(10) Patent No.: US 8,814,001 B2
(45) Date of Patent: Aug. 26, 2014

(54) MODULE WITH NOZZLE BOOT FOR A FUEL DISPENSING UNIT

(75) Inventors: Annika Birkler, Malmo (SE); Paul De La Port, Austin, TX (US); Bengt I Larsson, Skivarp (SE); Neil Thomas, Austin, TX (US); Kevin Christopher Burnett, Round Rock, TX (US); Hanna Helgesson, Dalby (SE); Scott R Negley, Austin, TX (US)

(73) Assignee: Wayne Fueling Systems LLC, Austin, TX (US)

( * ) Notice: Subject to any disclaimer, the term of this patent is extended or adjusted under 35 U.S.C. 154(b) by 140 days.

(21) Appl. No.: 13/502,327

(22) PCT Filed: Oct. 16, 2009

(86) PCT No.: PCT/EP2009/063623

§ 371 (c)(1),
(2), (4) Date: Apr. 16, 2012

(87) PCT Pub. No.: WO2011/044955

PCT Pub. Date: Apr. 21, 2011

(65) Prior Publication Data

US 2012/0211524 A1 Aug. 23, 2012

(51) Int. Cl.
*B67D 7/12* (2010.01)

(52) U.S. Cl.
USPC ..... 222/74; 222/173; 222/530; 222/538

(58) Field of Classification Search
USPC ..... 222/74, 173, 192, 530, 538; 141/382; 137/234.6; 248/75, 79, 80
See application file for complete search history.

(56) References Cited

U.S. PATENT DOCUMENTS

| | | | | | |
|---|---|---|---|---|---|
| 2,364,138 | A | * | 12/1944 | Grise | 222/34 |
| 4,131,218 | A | * | 12/1978 | Tatsuno | 222/527 |
| 4,240,475 | A | * | 12/1980 | Schulz | 141/392 |
| 4,252,161 | A | * | 2/1981 | Krupp | 141/279 |
| 5,083,846 | A | * | 1/1992 | Day et al. | 312/321.5 |
| 5,452,750 | A | * | 9/1995 | Miller et al. | 141/7 |
| 5,918,766 | A | * | 7/1999 | Osborne | 222/74 |

(Continued)

FOREIGN PATENT DOCUMENTS

| | | | |
|---|---|---|---|
| EP | 1860058 | A1 | 11/2007 |
| GB | 2242889 | A | 10/1991 |

(Continued)

OTHER PUBLICATIONS

Office Action from corresponding CN Application No. 200980162967.7, dated Jul. 1, 2013.

(Continued)

*Primary Examiner* — Kevin P Shaver
*Assistant Examiner* — Patrick M Buechner
(74) *Attorney, Agent, or Firm* — Mintz Levin Cohm Ferris Glovsky and Popeo, P.C.

(57) ABSTRACT

A nozzle module for a fuel dispensing unit is described. The nozzle module has a top section attachable to a column module of the fuel dispensing unit, a bottom section attachable to a base module of the fuel dispensing unit, at least one nozzle boot for holding a nozzle, which nozzle boot is arranged between the top section and the bottom section. The nozzle module has an internal channel enabling fluid communication through the nozzle module. A fuel dispensing unit is also described.

19 Claims, 4 Drawing Sheets

(56) References Cited

U.S. PATENT DOCUMENTS

| | | | | |
|---|---|---|---|---|
| 6,167,922 | B1 * | 1/2001 | Seitz et al. | 141/97 |
| 6,328,060 | B1 * | 12/2001 | Smith | 137/355.2 |
| 6,543,687 | B2 * | 4/2003 | Negley et al. | 235/381 |
| 8,430,429 | B2 * | 4/2013 | Larsson et al. | 285/82 |
| 2001/0029998 | A1 * | 10/2001 | White et al. | 141/98 |
| 2008/0006652 | A1 * | 1/2008 | Wemmert | 222/74 |
| 2010/0139782 | A1 * | 6/2010 | Deline et al. | 137/87.03 |
| 2011/0089190 | A1 * | 4/2011 | Gehman | 222/1 |
| 2012/0199242 | A1 * | 8/2012 | Larsson et al. | 141/311 R |
| 2012/0267370 | A1 * | 10/2012 | Birkler et al. | 220/254.6 |
| 2012/0305089 | A1 * | 12/2012 | Larsson | 137/1 |
| 2013/0001246 | A1 * | 1/2013 | Birkler et al. | 222/23 |
| 2013/0112706 | A1 * | 5/2013 | Larsson et al. | 222/74 |

FOREIGN PATENT DOCUMENTS

| | | | |
|---|---|---|---|
| WO | 9626155 | A1 | 8/1996 |
| WO | 9925644 | A1 | 5/1999 |
| WO | 2009023782 | A1 | 2/2009 |

OTHER PUBLICATIONS

International Search Report dated Jul. 30, 2010 which was issued in connection with PCT Application No. PCT/EP2009/063623 which was filed on Oct. 16, 2009.

* cited by examiner

MODULE WITH NOZZLE BOOT FOR A FUEL DISPENSING UNIT

TECHNICAL FIELD

The present invention relates to a nozzle module for a fuel dispensing unit and a fuel dispensing unit having such a nozzle module.

BACKGROUND ART

A fuel dispensing unit used for filling the fuel tank of a motor vehicle with fuel is a complex device containing a vast number of components connected to each other. The components of a fuel dispensing unit can be divided into two categories, the inner components which are not visual to a user and the outer components surrounding the inner components. The inner components typically comprise hydraulics and a tube arrangement for dispensing fuel from an underground fuel reservoir together with electronic components controlling the fuel dispensing unit. The outer components represent the fundamental structure of the fuel dispensing unit protecting and supporting the so important inner components. In view of the above, the number of components in a conventional fuel dispensing unit is very high. Due to this vast number of components required in a fuel dispensing unit, the costs for production and mounting is a constant issue is this line of business. Traditionally, there has been a great focus on the inner components in the development of fuel dispensing units, and thus also when addressing the problem of production and mounting costs. Accordingly, the development of the outer components of a fuel dispensing unit has not kept up with the one of the inner components. This fact is obvious from the prior art in this technical field.

Thus, a problem with the fuel dispensing units today is the costs for producing and mounting the high number of components, especially in regard of the so called outer components since the development of the same has kept a proportionately slow pace.

SUMMARY OF THE INVENTION

It is an object of the present invention to provide an improvement of the prior art. More particularly, it is an object of the present invention to decrease the number of components in a fuel dispensing unit and to simplify the mounting of the same.

These and other objects as well as advantages that will be apparent from the following description of the present invention are achieved by a nozzle module for a fuel dispensing unit and a fuel dispensing unit having such a nozzle module according to the claims below.

Thus, a nozzle module for a fuel dispensing unit is provided, comprising a top section attachable to a column module of said fuel dispensing unit, a bottom section attachable to a base module of said fuel dispensing unit, at least one nozzle boot for holding a nozzle, which nozzle boot is arranged between said top section and said bottom section, and an internal channel enabling fluid communication through said nozzle module. This is advantageous in that the assembling of the nozzle module will be facilitated. The nozzle module is placed above of the base module of a fuel dispensing unit and possible fuel pipe means may for example run from the base module, through the internal channel of the nozzle module, and further up in the column module placed above the nozzle module. Accordingly, the fuel pipe means is hidden and protected within the modules of the fuel dispensing unit. Further, the same nozzle module may be used in several different fuel dispensing units without greater modification. If the fuel dispensing unit for example is to carry several nozzles on each side of the fuel dispensing unit, the nozzle modules are slightly modified in order to be able to carry a plurality of nozzle boots. This way, the number of different components will be lowered effecting the production and mounting costs in an advantageously manner.

The bottom section may be adapted to be arranged above said base module of said fuel dispensing unit, which is advantageous in that the nozzle module will be given a rigid and stable support from said base module.

The internal channel may extend between said top section and said bottom section. In this way, the internal channel is hidden and protected within the nozzle module.

The internal channel may be adapted to receive a tube arrangement. In this way, parts of or the overall tube arrangement will be hidden and protected within said internal channel. Another possibility is that the internal channel comprises at least one tube of a tube arrangement. With this solution, the nozzle module may further comprise quick couplings for connecting the at least one tube with additional parts of said tube arrangement. This is advantageous in that a leak proof fluid communication between the at least one tube and the additional parts of the tube arrangement will be created. Tube arrangement may comprise separate tubes for fuel distribution and vapour recovery. When filling the fuel tank of a motor vehicle, it is a common measure to recover the vapour escaping the tank when filling it with liquid fuel. This measure is taken for both safety and environmental reasons. The vapour recovery is achieved, for instance, by arranging a vapour suction nozzle next to the fuel dispensing nozzle of a pistol grip for filling the tank with fuel. Vapour is then removed from the tank during filling, at a certain rate, which is often controlled by the standard rate of at which fuel is dispensed to the tank. Accordingly, since both fuel and potentially fuel vapour travels though the nozzle module, the assembly of the components together forming the tube arrangement is of great importance.

The nozzle module may have a cross section of a truncated cone, the bottom section forming the base of said truncated cone. Further, the nozzle module may have two parallel side sections each extending in a tapering manner from the bottom section to the top section, and two side sections which extend in a mutual converging manner from the bottom section to the top section. This is a suitable and aesthetically pleasing shape of the nozzle module.

The two side sections extending in a mutual converging manner from the bottom section to the top section may comprise at least one nozzle boot. The placement of the nozzle boot in an inclined section is advantageous in that the removal of the nozzle from said nozzle boot is facilitated.

The at least one nozzle boot may be integrally formed with said nozzle module, which is advantageous in a manufacturing perspective due to the reduction of yet a component in the fuel dispensing unit.

According to a second aspect of the present invention, the invention relates to a fuel dispensing unit comprising a nozzle module according to the above described features.

Generally, all terms used in the claims are to be interpreted according to their ordinary meaning in the technical field, unless explicitly defined otherwise herein. All references to "a/an/the [element, device, component, means, etc]" are to be interpreted openly as referring to at least one instance of said element, device, component, means, etc., unless explicitly stated otherwise.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION OF PREFERRED EMBODIMENTS OF THE INVENTION

Figure 1:
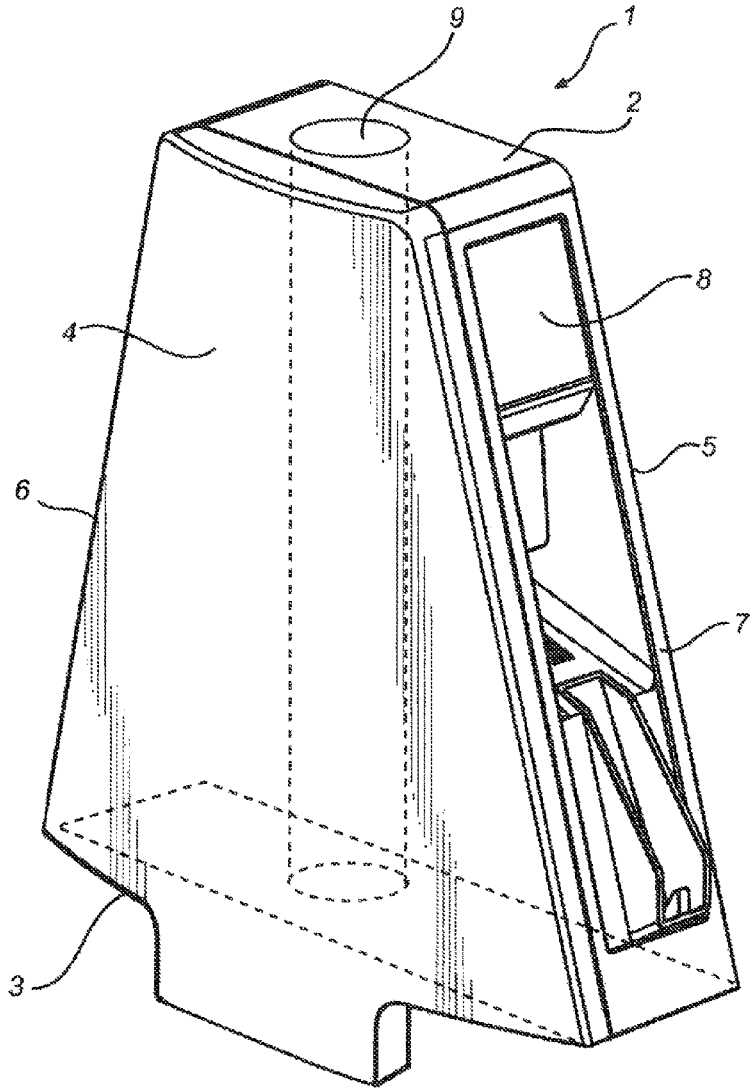
FIG. 1 is a perspective view of a nozzle module according to a first embodiment of the invention.

FIG. 1 illustrates a nozzle module 1 according to a first embodiment of the invention. The nozzle module 1 has a top section 2, a bottom section 3 and four side sections 4, 5, 6, 7. The top section 2 is attachable to a column module of a fuel dispensing unit and the bottom section 3 is attachable to a base module of a fuel dispensing unit. Two of the side sections 4, 5 are parallel and extend in a tapering manner from the bottom section 3 to the top section 2. The other two side sections 6, 7 extend in a mutual converging manner from the bottom section 3 to the top section 2. Accordingly, the nozzle module 1 has essentially a cross section of a truncated cone, wherein the bottom section 3 forms the base of the truncated cone. The side sections 6, 7 extending in a mutual converging manner from the bottom section 3 to the top section 2 comprises a nozzle boot 8, respectively. Each nozzle boot 8 is adapted to carry a nozzle. The nozzle module 1 has an internal channel 9 enabling fluid communication through the nozzle module 1. The internal channel 9 is adapted to receive a tube arrangement 19 of a fuel dispensing unit and extends between the top section 2 and the bottom section 3 of the nozzle module 1.

The nozzle module 1 may be provided with attachment means for attaching the nozzle module 1 to the base module of the fuel dispensing unit. In the embodiment shown in FIG. 1 this attachment means comprises protrusions extending from said side sections 4, 5. The base module may comprise recesses for receipt of these protrusions in the assembled state of the fuel dispensing unit.

Figure 2:
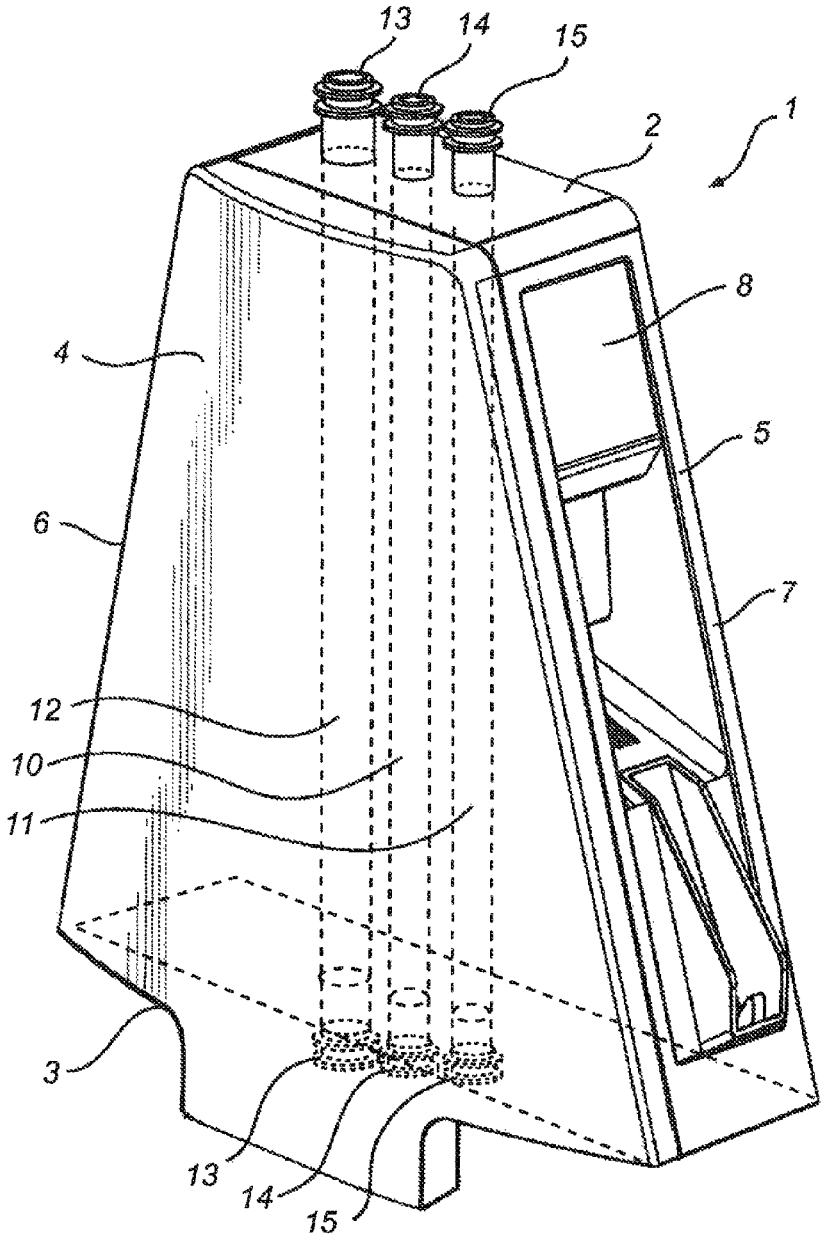
FIG. 2 is a perspective view of a nozzle module according to a second embodiment of the invention.

In FIG. 2, the nozzle module 1 is illustrated according to a second embodiment of the invention. In this embodiment, the nozzle module 1 the internal channel 9 comprises has three internal tubes 10, 11, 12. Two of the internal tubes 10, 11 are fuel lines and one of the internal tubes 12 is a common vapour recovery line. The nozzle module 1 further comprises quick 25 couplings 13, 14, 15 for connecting the three internal tubes 10, 11, 12 with tubes of a fuel dispensing unit. Naturally, the amount of internal tubes may be varied due to the amount of hoses carried by the fuel dispensing unit in which the nozzle module 1 is assembled, if vapour recovery means are present or not and how these means in that case are provided.

Figure 3:
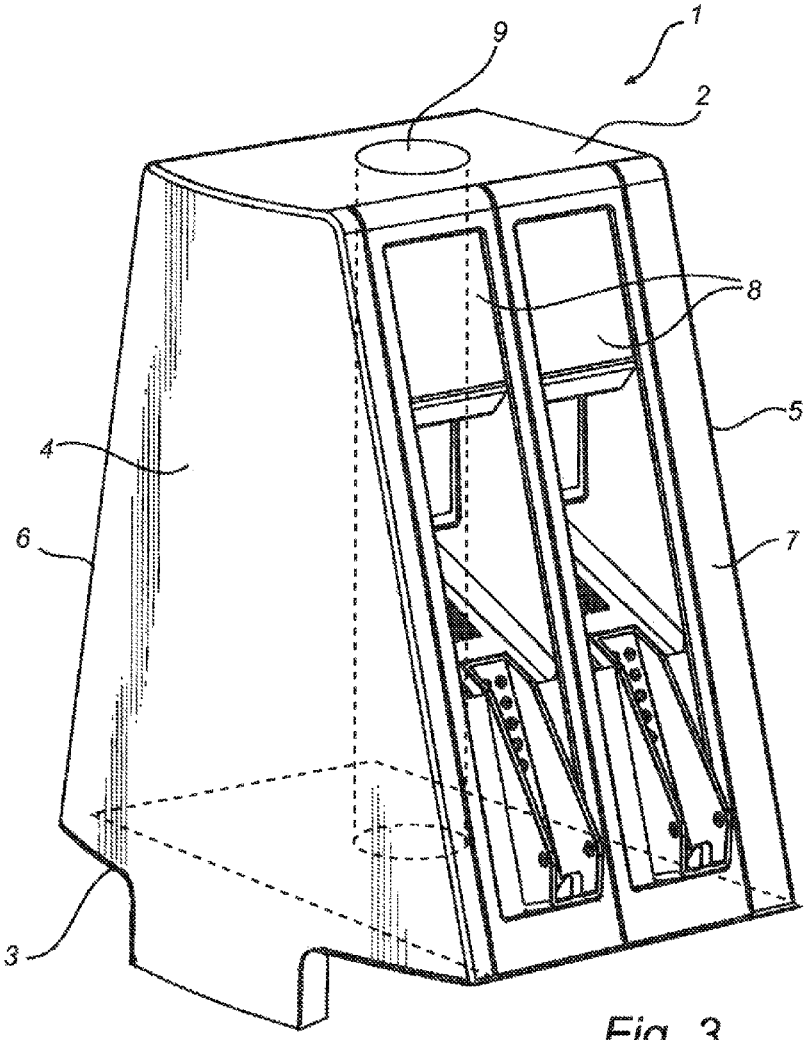
FIG. 3 is a perspective view of a nozzle module according to a third embodiment of the invention.

FIG. 3 illustrates the nozzle module 1 according to a third embodiment of the invention. In this embodiment, the side sections 6, 7 extending in a mutual converging manner from the bottom section 3 to the top section 2 comprises two nozzle boots 8, respectively. Each nozzle boot 8 is adapted to carry a nozzle.

Figure 4:
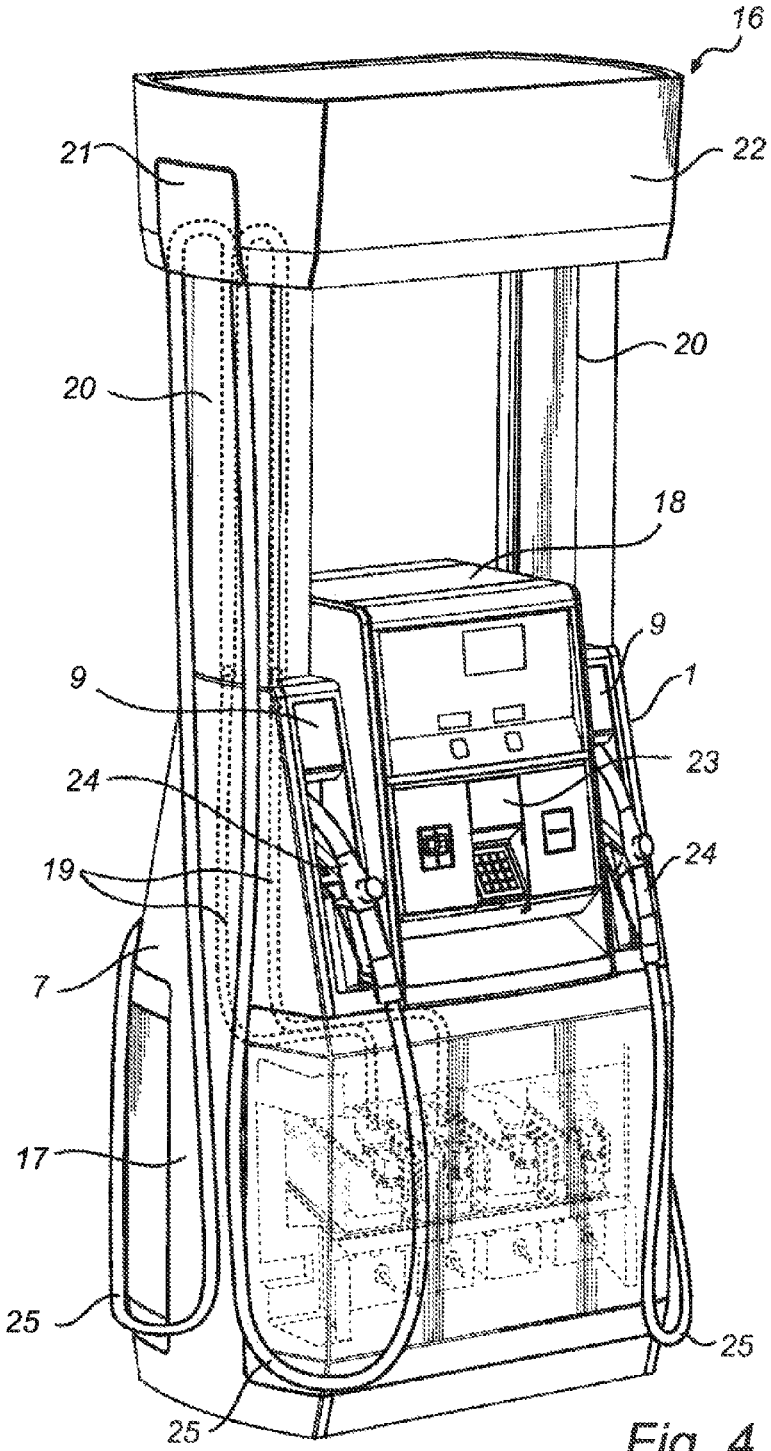
FIG. 4 is a perspective view of a nozzle module according to the first embodiment of the invention when assembled in a fuel dispensing unit.

FIG. 4 illustrates a fuel dispensing unit 16 having two nozzle modules 1, one on each side of the fuel dispensing unit 16. The fuel dispensing unit 16 comprises six different types of modules 17, 18, 1, 20, 21, 22. The modules 17, 18, 1, 20, 21, 22 are constituted by a base module 17, an electronics module 18, two nozzle modules 1, two column modules 20, a top module 21 and a display module 22.

The electronics module 18 is arranged above of the base module 17, 10 the nozzle modules 1 are arranged above the base module 17, the column modules 20 are arranged above the nozzle modules 1 and the top module 21 is arranged above the column modules 20.

The arrangement of one module above or on top of another module results in joints between modules extending in a horizontal direction.

The base module 17 contains the hydraulics (not shown) of the fuel dispensing unit 16, such as fuel metering means, valves, pumps, vapour recovery system, etc. The exterior of the base module 17 comprises display surfaces for prints. The electronics module contains means for controlling the fuel dispensing unit 16 and comprises a user interface 23 on one of its outer surfaces. The user interface 23 is adapted to show pump data and is equipped to handle payment of fuel after refueling. Each one of the nozzle modules 1 holds two nozzle boots 8, one on each side of the nozzle module 1, which nozzle boots 8 are intended to carry a nozzle 24, respectively. The nozzle boots 8 may be integrally formed with the nozzle module 1. The column modules 20 are to be arranged above or on top of the nozzle module 1 in order to elevate and support the top module 21 when assembled. The top module 21 itself comprises display surfaces for prints. However the top module 21 is also adapted to receive a display module 22, which in turn comprises display surfaces for prints.

When assembling the fuel dispensing unit 16, the base module 17 is positioned on the ground in a suitable location for the fuel dispensing unit 16. The electronics module 18 is arranged on top of the base module 17, whereby the user interface 23 will be located in a suitable height for a user of the fuel dispensing unit 16. A through opening is provided in the electronics module 18 separating said user interface 23 from said base module 17. Two nozzle modules 1 are arranged on top of the base module 17, one on each side of the electronics module 18. Each nozzle module 1 carries two nozzle boots 8 located opposite to each other and adapted to receive a nozzle 24, respectively. A column module 20 is arranged on top of each one of the nozzle modules 1. The two column modules 20 in turn carry a top module 21, which is arranged on top of the two column modules 20. A display module 22 is arranged at the top module 21, which display module 22 partly surrounds the top module 21. The display module 22 comprises display surfaces for prints.

The fuel dispensing unit 16 has a tube arrangement 19 and a hose 25 connected thereto for transporting fuel from an underground fuel reservoir (not shown) to the nozzle 24. The tube arrangement 19 extends from the underground fuel reservoir to and through the nozzle module 1. Above the nozzle module 1, the tube arrangement 19 is connected to the hoses 25 belonging to that particular side of the fuel dispensing unit 16. The same connection between the tube arrangement 19 and the hoses 25 is made in the nozzle module 1 located on the other side of the fuel dispensing unit 16. The hoses 25 then in turn extend from the nozzle module 1 to a respective nozzle 24 via the column module 20 and the top module 21. This way, the tube arrangement 19 is enclosed by the base module 17, the nozzle module 1, and the hoses 25 are partly enclosed by the column module 20 and the top module 21. The tube arrangement 19 may, however, extend from said base module 17 to the column module 20 and be connected to the hoses 25 in the column module 20. The hoses 25 then extend from the column module 20 to the nozzles 24 via the top module 21. Another possibility is for the tube arrangement 19 to extend from the base module 17 all the way to the top module 21. With this solution the hoses 25 then extend directly from the top module 21 to the nozzles 24.

When assembling the nozzle module 1 in the fuel dispensing unit 16, the nozzle module 1 is thread over the tube arrangement 19 and placed on top of the base module 17, such that a part of the tube arrangement is enclosed by the nozzle module 1.

The nozzle module 1 may also be adapted to contain electronic cables which for example are to extend between different parts of the electronics module 18.

The nozzle module 1 may have at least one protrusion projecting upwardly in a substantially vertical direction of the fuel dispensing unit 16 to be received in a corresponding a recess of the column module 20, in order to position the column module 20 in relation to the nozzle module 1. The extension of the at least one protrusion may of course be varied. In one embodiment, the at least one protrusion extends throughout the entire length of the column module 20 and into the top module 21. In another embodiment, the at least one protrusion extend substantially throughout the length of the column module 20.

The nozzle module 1 may have a recess for receiving a corresponding protrusion of the column module 20, in order to position the column module 20 in relation to the nozzle module 1. The nozzle module 1 may have at least one protrusion projecting downwardly in a substantially vertical direction of the fuel dispensing unit 16 to be received in a corresponding a recess of the base module 17, in order to position the nozzle module 1 in relation to the base module 17. The extension of the al least one protrusion may of course be varied.

The nozzle module 1 may have a recess for receiving a corresponding protrusion of the base module 17, in order to position the nozzle module 1 in relation to the base module 17.

According to a second aspect of the invention a fuel dispensing unit is provided comprising a nozzle module according to the above described features. The invention has mainly been described above with reference to a new embodiments. However, as is ready appreciated by a person skilled in the art, other embodiments than the ones disclosed above are equally possible within the scope of the inventions, as defined by the appended claims.

The invention claimed is:

1. A nozzle module for a fuel dispensing unit, the nozzle unit comprising:
   - a top section attachable to a column module of the dispensing unit;
   - a bottom section attachable to a base module of the dispensing unit;
   - at least one nozzle boot for holding a nozzle, the nozzle boot arranged between the top section and the bottom section; and
   - an internal channel enabling fluid communication through the nozzle module, wherein the internal channel extends through the bottom section.

2. The nozzle module according to claim 1, wherein the bottom section is adapted to be arranged above the base module of the fuel dispensing unit.

3. The nozzle module according to claim 1, wherein the internal channel is adapted to receive a tube arrangement.

4. The nozzle module according to claim 1, wherein the internal channel comprises at least one tube of a tube arrangement.

5. The nozzle module according to claim 4, wherein the nozzle module further comprises quick couplings for connecting the at least one tube with additional parts of the tube arrangement.

6. The nozzle module according to claim 3, wherein the tube arrangement comprises separate tubes for fuel distribution and vapour recovery.

7. The nozzle module according to claim 1, wherein the nozzle module has a cross section of a truncated cone, the bottom section forming the base of the truncated cone.

8. The nozzle module according to claim 7, wherein the nozzle module has two parallel side sections each extending in a tapering manner from the bottom section to the top section.

9. The nozzle module according to claim 7, wherein the nozzle module has two side sections which extend in a mutual converging manner from the bottom section to the top section.

10. The nozzle module according to claim 9, wherein the two side sections extending in a mutual converging manner from the bottom section comprise at least one nozzle boot.

11. The nozzle module according to claim 1, wherein the at least one nozzle boot is integrally formed with the nozzle module.

12. A fuel dispensing unit for refueling vehicles, the fuel dispensing unit comprising:
   - a nozzle module comprising:
     - a top section attachable to a column module of the dispensing unit;
     - a bottom section attachable to a base module of the dispensing unit;
     - at least one nozzle boot for holding a nozzle, the nozzle boot arranged between the top section and the bottom section; and
     - an internal channel enabling fluid communication through the nozzle module, wherein the internal channel extends through the bottom section.

13. The fuel dispending unit according to claim 12, wherein the bottom section is adapted to be arranged above the base module of the fuel dispensing unit.

14. The fuel dispending unit according to claim 12, wherein the internal channel is adapted to receive a tube arrangement.

15. The fuel dispending unit according to claim 12, wherein the internal channel comprises at least one tube of a tube arrangement.

16. The fuel dispending unit according to claim 15, wherein the nozzle module further comprises quick couplings for connecting the at least one tube with additional parts of the tube arrangement.

17. The fuel dispending unit according to claim 14, wherein the tube arrangement comprises separate tubes for fuel distribution and vapour recovery.

18. The fuel dispending unit according to claim 12, wherein the nozzle module has a cross section of a truncated cone, the bottom section forming the base of the truncated cone.

19. The fuel dispensing unit according to claim 18, wherein the nozzle module has two parallel side sections, each extending in a tapering manner from the bottom section to the top section.

* * * * *